United States Patent [19]

Kerr

[11] Patent Number: 5,053,262

[45] Date of Patent: Oct. 1, 1991

[54] CHILD'S SERVING MAT

[76] Inventor: Pamela J. Kerr, 19536 Elk Ridge Dr., Keedysville, Md. 21756

[21] Appl. No.: 553,188

[22] Filed: Jul. 16, 1990

[51] Int. Cl.[5] ..... A47G 19/02

[52] U.S. Cl. ..... 428/81; 248/206.4; 248/346.1; 428/192

[58] Field of Search ..... 428/81, 119, 192; 248/206.3, 206.4, 346.1

[56] References Cited

U.S. PATENT DOCUMENTS

| | | | |
|---|---|---|---|
| 2,585,515 | 2/1952 | Talboys | 428/99 |
| 2,728,165 | 12/1955 | Runyon | 108/90 X |
| 2,757,478 | 8/1956 | Borland | 248/346.1 |
| 2,897,108 | 7/1959 | Harwood | 428/198 X |
| 3,517,407 | 6/1970 | Wyant | 428/121 X |
| 3,729,037 | 4/1973 | Dare et al. | 248/346.1 X |
| 3,920,870 | 11/1975 | Ackerman et al. | 428/121 X |
| 4,143,194 | 3/1979 | Wihksne | 428/192 X |
| 4,328,275 | 5/1982 | Vargo | 428/192 X |
| 4,346,875 | 8/1982 | Spencer et al. | 428/99 X |
| 4,457,964 | 7/1984 | Kaminstein | 428/131 X |
| 4,483,895 | 11/1984 | Deaver | 428/198 |
| 4,617,215 | 10/1986 | Telesco | 283/56 X |
| 4,691,955 | 9/1987 | Pousar | 294/142 |
| 4,822,669 | 4/1989 | Roga | 428/287 |
| 4,940,620 | 7/1990 | Silk et al. | 428/81 |

*Primary Examiner*—Henry F. Epstein
*Attorney, Agent, or Firm*—Leon Gilden

[57] ABSTRACT

A mat construction defined by a flexible central web to define a sanitary top surface wherein a matrix of suction cups are mounted to an associated bottom surface to permit the mat structure to be rolled up prior to and subsequent to use. Modifications of the invention include a flexible wall integrally mounted to the central web wherein the central web is formed with a concave surface to accommodate fluid medially of the central web and wherein suction cups are arranged adjacent opposed side edges of the central web to effect the concave configuration of the mat structure.

1 Claim, 4 Drawing Sheets

CHILD'S SERVING MAT

BACKGROUND OF THE INVENTION

1. Field of the Invention

The field of the invention relates to serving mat organizations, and more particularly pertains to a new and improved child's serving mat wherein the same provides a sanitary serving surface for repeated use.

2. Description of the Prior Art

In Contemporary society, the dining in "fast food" establishments is well known. Frequently, serving areas on tables and the like lack desired sanitary conditions and particularly wherein children subject to various viral infections are concerned. It is desirable to provide a readily reuseable serving mat organization to define a surface for accommodation of foods within a restaurant environment. Examples of the prior art include U.S. Pat. No. 4,457,964 to KAMINSTEIN setting forth a place mat structure mounted upon a roll utilizing perforations to separate adjacent sheets for use as a mat member.

U.S. Pat. No. 3,920,870 to ACKERMAN et al sets forth a place mat construction formed with a graphic pattern insert mounted within a flap defined by the organization.

U.S. Pat. No. 2,728,165 to RUMYON provides a table cover and food covering provided by spaced fastener members mounted to adjacent cooperative ends of plural layers of the construction to contain utensils plates and the like therewithin.

U.S. Pat. No. 4,617,215 to TELSCO sets forth a place mat wherein a central sheet of paper includes easily separated portions around the central sheet to provide secondary functions such as coupons and the like.

U.S. Pat. No. 4,691,955 to POUSAR provides a rigid place mat defining a patch like case to receive a rigid plate as a stiffener of the place mat.

As such, it may be appreciated that there continues to be a need for a new and improved child's serving mat organization as set forth by the instant invention which addresses both the problems of ease of use as well as effectiveness in construction and in this respect, the present invention substantially fulfills this need

SUMMARY OF THE INVENTION

In view of the foregoing disadvantages inherent in the known types of serving mat apparatus present in the prior art, the present invention provides a new and improved child's serving mat wherein the same provides for a readily reuseable serving mat easily folded and/or rolled for ease of transport and storage during periods of non-use. As such, the general purpose of the present invention, which will be described subsequently in greater detail, is to provide a new and improved child's serving mat which has all the advantages of the prior art serving mat structure and none of the disadvantages.

To attain this, the child's serving mat of the instant invention includes a mat construction defined by a flexible central web to define a sanitary top surface wherein a matrix of suction cups are mounted to an associated bottom surface to permit the mat structure to be rolled up prior to and subsequent to use. Modifications of the invention include a flexible wall integrally mounted to the central web wherein the central web is formed with a concave surface to accommodate fluid medially of the central web and wherein suction cups are arranged adjacent opposed side edges of the central web to effect the concave configuration of the mat structure.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved child's serving mat which has all the advantages of the prior art child's serving mat and none of the disadvantages.

It is another object of the present invention to provide a new and improved child's serving mat which may be easily and efficiently manufactured and marketed.

It is a further object of the present invention to provide a new and improved child's serving mat which is of a durable and reliable construction.

An even further object of the present invention is to provide a new and improved child's serving mat which is susceptible of a low cost of manufacture with regard to both materials and labor, and which accordingly is then susceptible of low prices of sale to the consuming public, thereby making such child's serving mats economically available to the buying public.

Still yet another object of the present invention is to provide a new and improved child's serving mat which provides in the apparatuses and methods of the prior art some of the advantages thereof, while simultaneously overcoming some of the disadvantages normally associated therewith.

Still another object of the present invention is to provide a new and improved child's serving mat which may be compactly stored when not being utilized.

Yet another object of the present invention is to provide a new and improved child's serving mat wherein the same provides a readily reuseable sanitary serving surface readily reuseable in a variety of eating environments.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
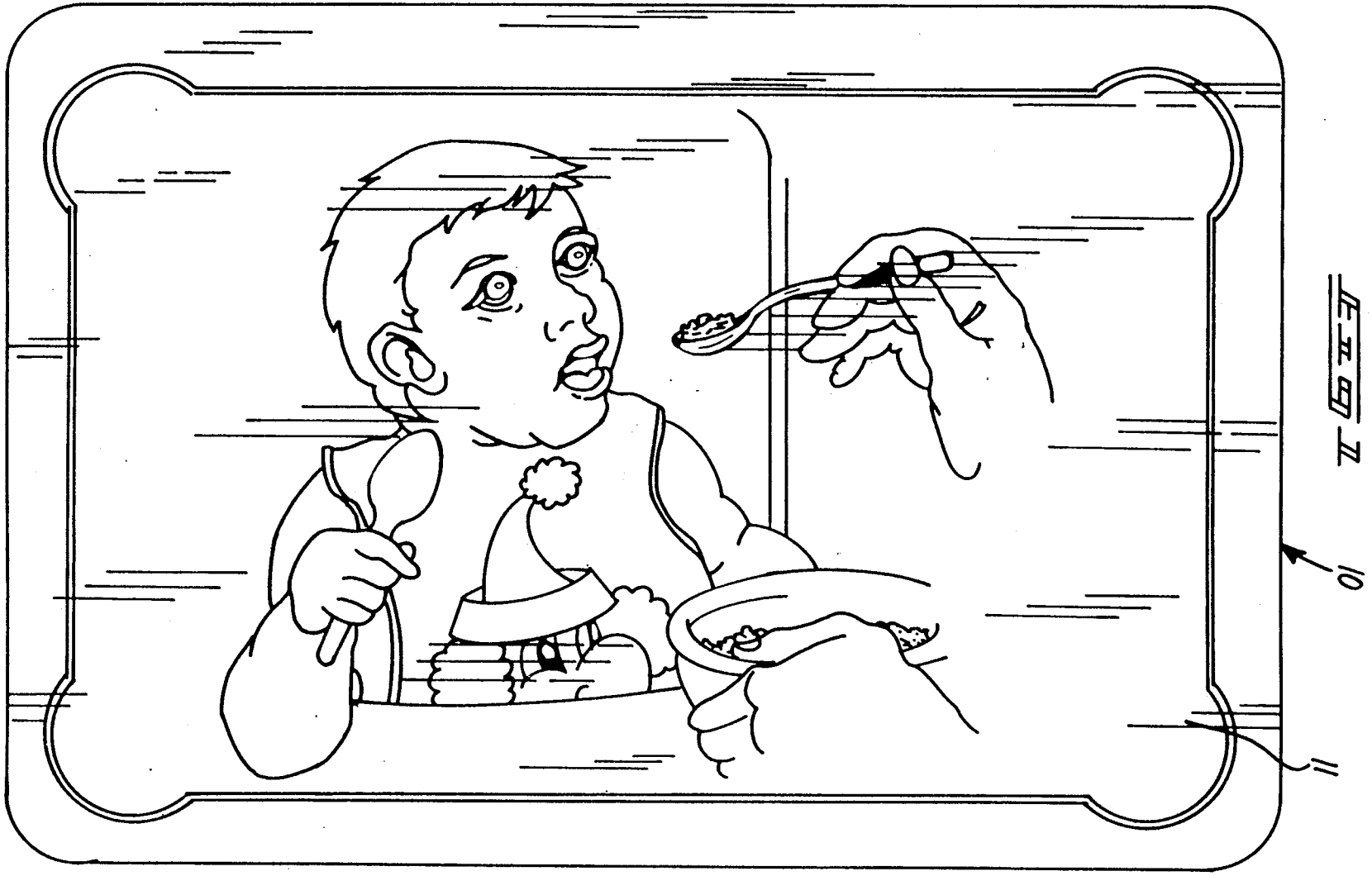
FIG. 1 is a top orthographic view of the instant invention.

With reference now to the drawings, and in particular to FIGS. 1 to 7 thereof, a new and improved child's serving mat embodying the principles and concepts of the present invention and generally designated by the reference numerals 10, 10*a*, and 10*b* will be described.

Figure 2:
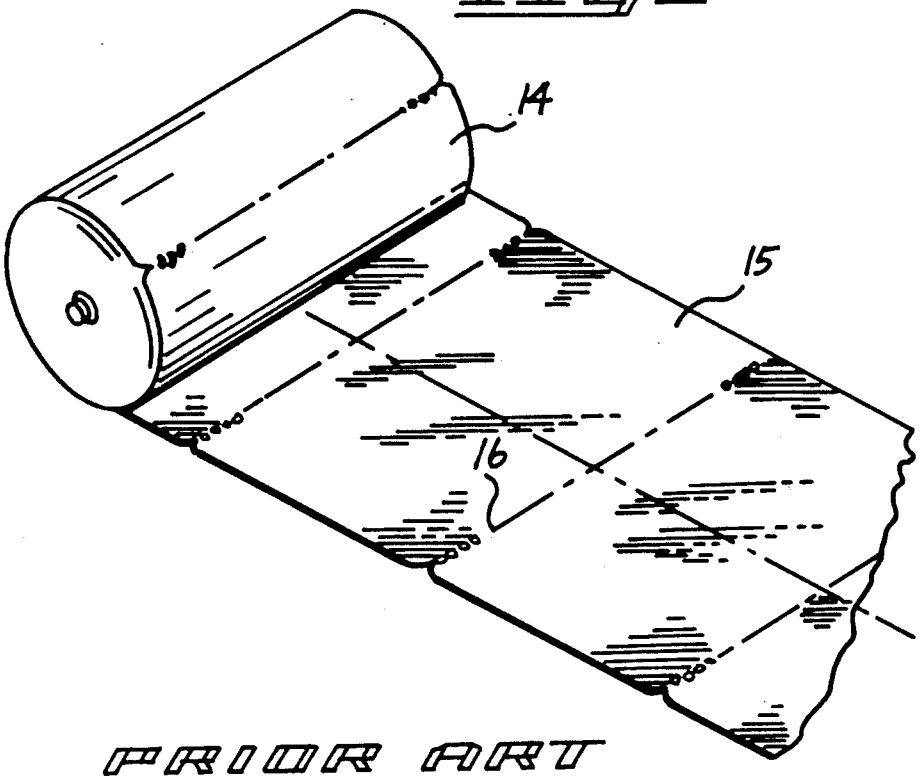
FIG. 2 is an isometric illustration of a prior art serving mat organization.

FIG. 2 illustrates a prior art serving mat construction wherein a treated towel roll 14 includes a series of aligned sheets 15 selectively separable relative to one another by parallel perforations 16 positioned between adjacent sheets.

Figure 3:
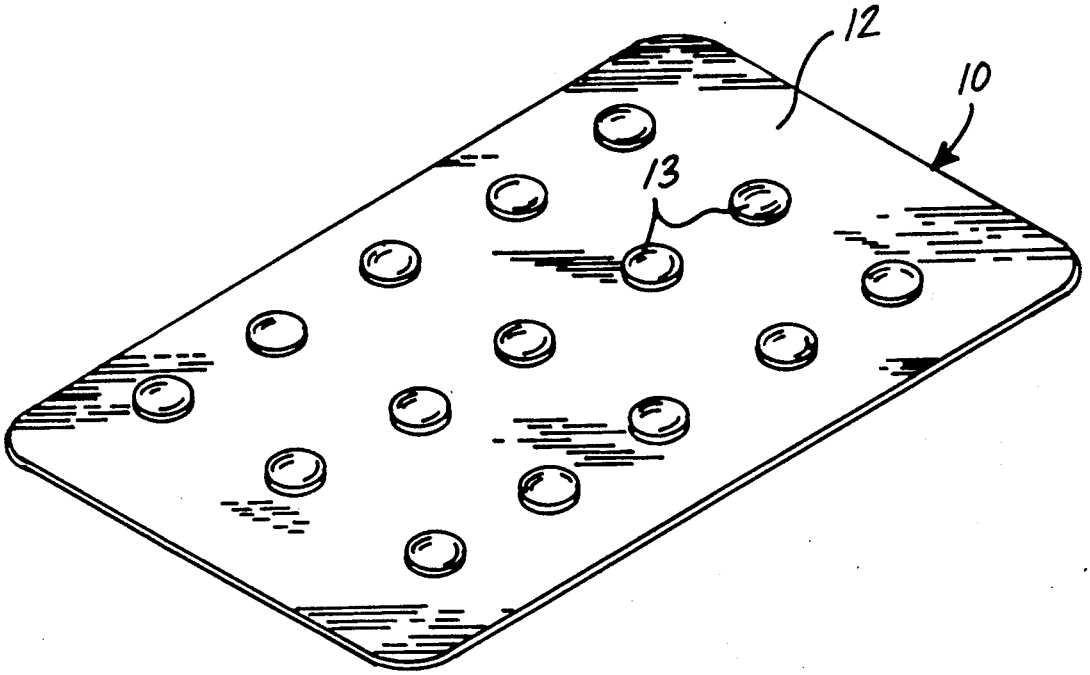
PRIOR ART FIG 3
FIG. 3 is an isometric illustration of the bottom surface of the instant invention.
Figure 4:
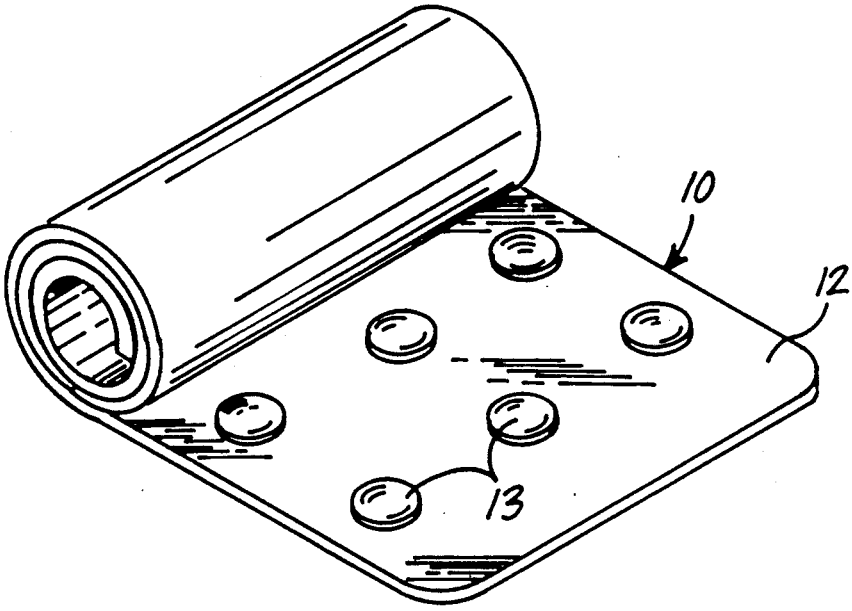
FIG. 4 is an isometric illustration of the instant invention in a rolled condition for storage and transport.
Figure 7:
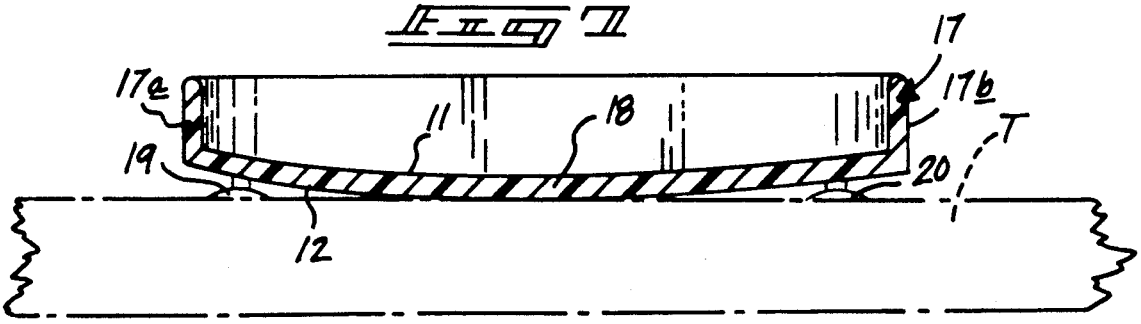
FIG. 7 is an orthographic cross-sectional view taken along the lines 7—7 of FIG. 6 in the direction indicated by the arrows.

More specifically, the child's serving mat 10 of the instant invention essentially includes an upper top surface 11 coextensive with and overlying a bottom surface 12. FIG. 3 illustrates the use of a matrix of suction cups 13 fixedly mounted to the bottom surface 12 to enhance fixed securement to a support surface such as a table T as illustrated in FIG. 7. The mat construction is formed of a flexible fluid impermeable material wherein a suitable polymeric is desirable for fixed longevity and readily reuseable surface to permit repeated sanitizing of the top surface 11.

Figure 5:
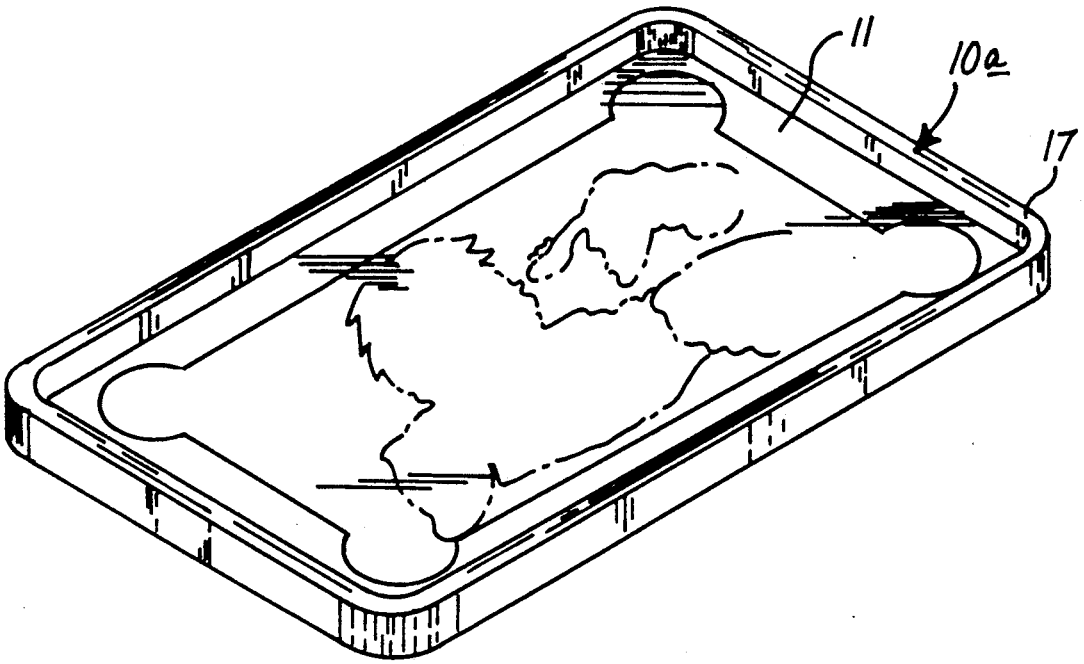
FIG. 5 is an isometric illustration of the modification of instant invention.
Figure 6:
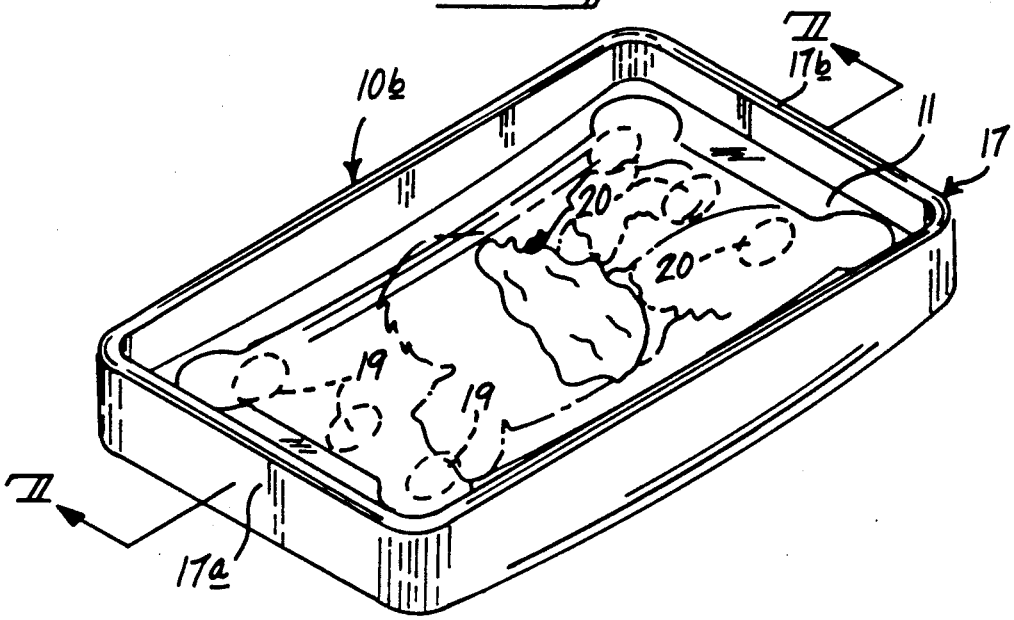
FIG. 6 is an isometric illustration of a further modification of the instant invention.

FIG. 5 illustrates the use of a surrounding wall 17 orthogonally arranged relative to the central top surface 11 wherein FIG. 6 illustrates a wall 17 that includes spaced side walls including a first side wall 17*a* and a parallel second side wall 17*b*. The surrounding wall structure 17 overlies a concave continuous arcuate top surface 11 defining the central floor web 18. Mounted to the bottom surface 12 are a first row of suction cups 19 arranged parallel to the first side wall 17A and directed downwardly relative to the bottom surface 12 wherein the first row of suction cups 19 is arranged parallel relative to a second row of suction cups 20 that in turn is arranged parallel to and adjacent the second side wall 17*b*. The suction cups effect and enhance the concave curvature of the top surface 11 wherein various fluids that are spilled and the like will concentrate towards the center portion of the top surface 11 to enhance cleaning and the like. The flexible construction of the floor web 18 will accommodate a flattening when foods and the like are positioned upon the floor and still maintain the arcuate surface as illustrated in FIG. 7. The surrounding wall 17 is defined by a first thickness less than that of a second thickness defined by the floor web 18 to enhance over folding and rolling of the mat structure for storage and transport thereof.

As to the manner of usage and operation of the instant invention, the same should be apparent from the above disclosure and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A unitary serving mat organization comprising, a flexible central web, the flexible central web including a top surface coextensive with and overlying a bottom surface, and a plurality of suction cups fixedly mounted fixedly to the bottom surface extending outwardly therefrom and wherein the central web includes a peripheral perimeter, and a surrounding wall integrally mounted to the perimeter, and the surrounding wall formed of a flexible polymeric material, and the surrounding wall and the central web defining a fluid impermeable material, and wherein the surrounding wall is defined by a first thickness and the central web is defined by a second thickness wherein the first thickness is less than that of the second thickness to enhance inter-folding of the surrounding wall relative to the central web and permit rolling of the mat for storage and transport, and wherein the top surface defines an arcuate concave surface, to effect positioning of fluids directed onto the top surface medially of the top surface, and wherein the surrounding wall includes a first side wall spaced from and parallel a second side wall, and the suction cups include a first row of suction cups arranged parallel to and adjacent the first side wall, and a second row of suction cups arranged parallel to the first row of suction cups wherein the second row of suction cups is oriented adjacent the second side wall.

* * * * *